US006066819A

United States Patent [19]

Takano et al.

[11] Patent Number: 6,066,819

[45] Date of Patent: May 23, 2000

[54] PUSH BUTTON SUPPORT STRUCTURE FOR PUSH SWITCH

[75] Inventors: Tsunesuke Takano; Takeshi Sato, both of Tokyo, Japan

[73] Assignee: Kabushiki Kaisha T AN T, Tokyo, Japan

[21] Appl. No.: 09/318,808

[22] Filed: May 26, 1999

[51] Int. Cl.[7] ..... H01H 13/00

[52] U.S. Cl. ..... 200/345

[58] Field of Search ..... 200/5 A, 517, 200/520, 341, 344, 345; 400/472, 490, 491, 491.2, 495, 495.1, 496

[56] References Cited

U.S. PATENT DOCUMENTS

| | | | |
|---|---|---|---|
| 4,433,225 | 2/1984 | Cowles | 200/340 |
| 4,939,324 | 7/1990 | English et al. | 200/345 |
| 5,283,408 | 2/1994 | Chen | 200/345 |
| 5,669,723 | 9/1997 | Chang | 400/496 |
| 5,670,759 | 9/1997 | Hsu | 200/5 A |

FOREIGN PATENT DOCUMENTS

| | | | |
|---|---|---|---|
| 2311 962 | 10/1997 | United Kingdom | B41J 5/12 |

*Primary Examiner*—Michael Friedhofer
*Attorney, Agent, or Firm*—Nixon & Vanderhye P.C.

[57] ABSTRACT

A push button support structure for a push switch is provided with a housing, a push switch secured to the housing which has an actuator thereon, and a push button reciprocally moveable between on and off positions so as to responsively engage the actuator and thereby perform on and off switching actions, respectively. A pair of first elongate engagement posts is provided on one of the push button or housing which defines a circular cross-sectional geometry. Each elongate engagement post is positioned on a respective side of the push switch so that the push switch is disposed between the pair of first elongate engagement posts. A pair of second elongate engagement posts, in alignment with the pair of first elongate engagement posts, is also provided on the other of the push button or housing and defines a square cross-sectional geometry. Respective ones of the first and second pairs of elongate engagement posts are coaxially mated with one another for relative slidable movement therebetween, and are sized and configured so as to establish orthogonally oriented pairs of diametrically opposed linear contact regions therebetween. As a result, frictional resistance is minimized during reciprocal movement of the push button.

5 Claims, 6 Drawing Sheets

PUSH BUTTON SUPPORT STRUCTURE FOR PUSH SWITCH

BACKGROUND OF THE INVENTION

The present invention relates to a support structure for supporting the push button mounted to the actuator of the push switch for turning on and off the indoor room lihts such as a light attached to the center of the roof of the automotive room, the map lamp forwardly of the driver's seat or the like to prevent the push button from listing at the time when said switch is pressed down for turning on and are again pressed down for turning off the lights.

One example of the map lamps for automotive indoor illumination used in the prior art will be explained with reference to FIGS. 7 through 9.

A housing 1 to which a lamp (not shown) is attached has a transparent or translucent lens 2 secured thereto at a front thereof. Said housing 1 has a push switch 3 (hereinafter referred to as merely a switch) for turning on and off said lamp and said switch is secured to a platform 11 formed integrally to one side of said housing 1. Said switch 3 has an actuator 31 which are to be engaged with a push button 4 and is adapted to be operated from the front of the housing. On the underside of the push button 4, a cylindrical rod 41 is integrally formed thereto to be inserted into a cylindrical bearing 12 integrally formed to the platform 11.

The terminal (not shown) of the thus constructed switch 3 is electrically connected to the power source (or the automotive battery) and is adapted to turn on the switch 3 to put on the light by being pressed down and to turn off the same to put out the light by again being pressed down again.

Since the rod 41 is guided along said bearing 12 therewithin, the button is prevented from listing sideways at the time of the push button 4 being pressed down to ensure that said push button 4 is vertically pressed down to in turn press down the actuator 31 positively to assure a proper switching on and off actions.

In this connection, said push button having rods 41 being inserted into the bearing 12 which is tubular provides a large contact area between the rods 41 and the bearing 12. This structure gives a rise to a considerable frictional resistance when pressing down the push button 4, thus preventing a smooth pressing down of the same.

Further, the prior art as described in the foregoing employs cylindrical rods 41 and tubular bearings 12, which can prevent smooth pressing down of the push button if the outer diameter of the rods 41 and the inner diameter of the bearings 12 are substantially equal because it provides too tight engagement while if the difference between said outer diameter and said inner diameter are too large, an unnecessary play can cause a resultant deflection of the push button at the time of the pressing down action.

SUMMARY OF THE INVENTION

The present invention is intended to solve the problems referred to in the foregoing and its object is to provide a push button support structure for the push switch by constructing either of the rod and the bearing in a cylindrical structure and the other in a polygonal structure such that corners of one member are brought into the other to minimize the contact area. As a result, the frictional resistance is reduced as well as preventing any unnecessary play between the rod and the bearing.

The push button support structure for the push switch of the present invention is to solve the problems referred to in the foregoing and essentially the invention provides a push button support structure for a push switch comprising a housing; a push switch secured to said housing and having an actuator thereon; a push button to be brought into engagement with said actuator to perform switching on and off actions; first engagement means provided on the underside of said push button; and second engagement means provided on the housing to mate with said first engagement means, said second engagement means being sized to provide a bearing/rod engagement in cooperation with said first engagement means, said bearing/rod engagement including a polygon/cylinder fit to produce a linear contact therebetween.

BRIEF EXPLANATIN OF THE DRAWINGS

FIG. 6-1 is a cross sectional plan view showing the primary portion of the above figure;

FIG. 6-2 is a cross sectional plan view showing the primary portion of a modification of FIG. 6-1.

DESCRIPTION OF THE EMBODIMENTS

Hereinafter, one mode of embodiment according to the present invention relating to the push button support structure for a push button for the push switch will be explained with reference to FIG. 1 and FIG. 2.

In this connection, since similar numerals and similar characters to those used in the aforementioned prior art denote similar members, the explanation of such numerals and characters will be omitted.

In this mode of embodiment, while square pillar rods 42 are provided on the push button 4, cylindrical bearings 12 are provided on the platform 11. Further, said cylindrical bearings 12 have inner walls which are sized to be brought into linear contact with corners of said square pillar rods 42.

Figure 3:
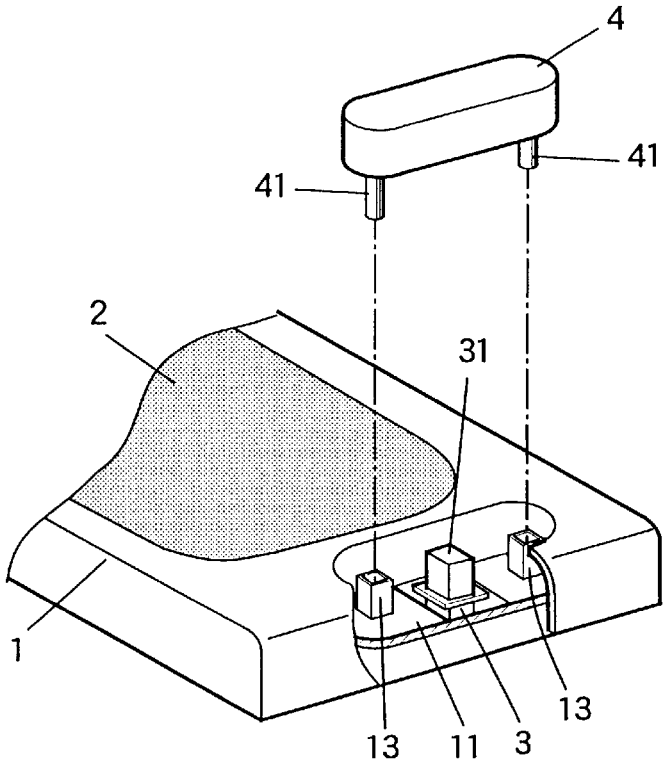
FIG. 3 is an exploded perspective view showing the second mode of embodiment.
Figure 4:
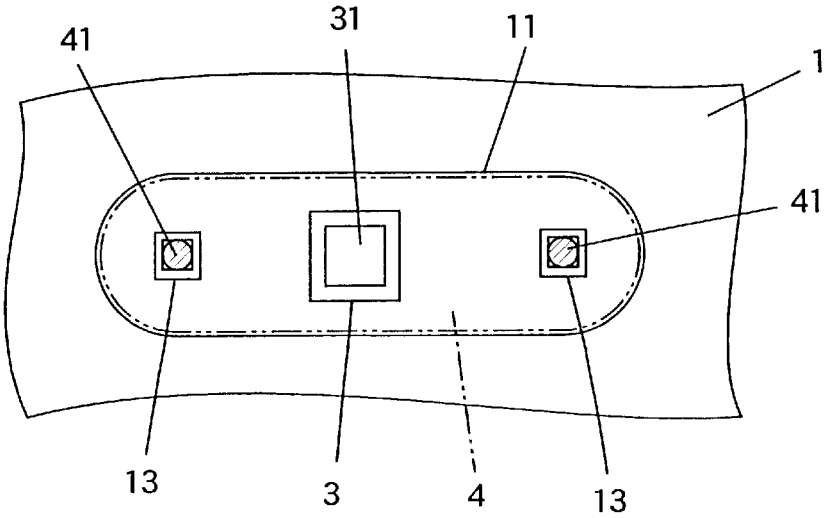
FIG. 4 is a cross sectional plan view showing the primary portion of the above figure.

FIG. 3 and FIG. 4 show the second mode of embodiment, in which cylindrical rods 41 are provided on the push button 4 while square bearings 13 are provided on the platform 11 such that the cylindrical peripheral surface of the cylindrical rods 41 is sized to be brought into linear contact with the inner walls of the square bearings 13 at four positions.

In the thus constructed support structure of the present invention, the cylindrical rods 41 on the push button 4 are maintained in linear and snug contact with the square bearings 12 and 13 on the housing 1 with the result that the push button 4 is pressed down with fewer frictional resistance and without unnecessary play therebetween, thus assuring turning on and off actions by smooth pressing down of the switch 3.

Figure 1:
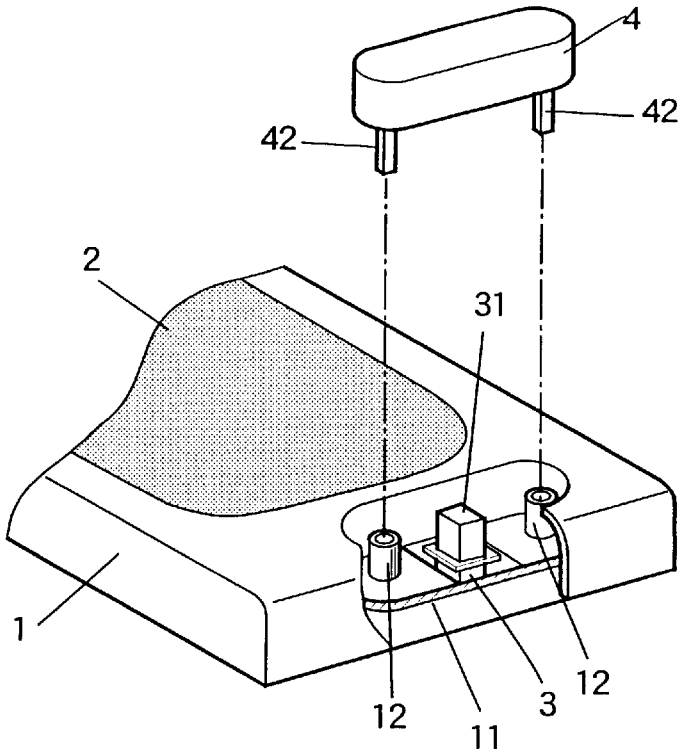
FIG. 1 is an exploded perspective view of the first mode of embodiment of the present invention directed to the push button support structure for the push switch.
Figure 5:
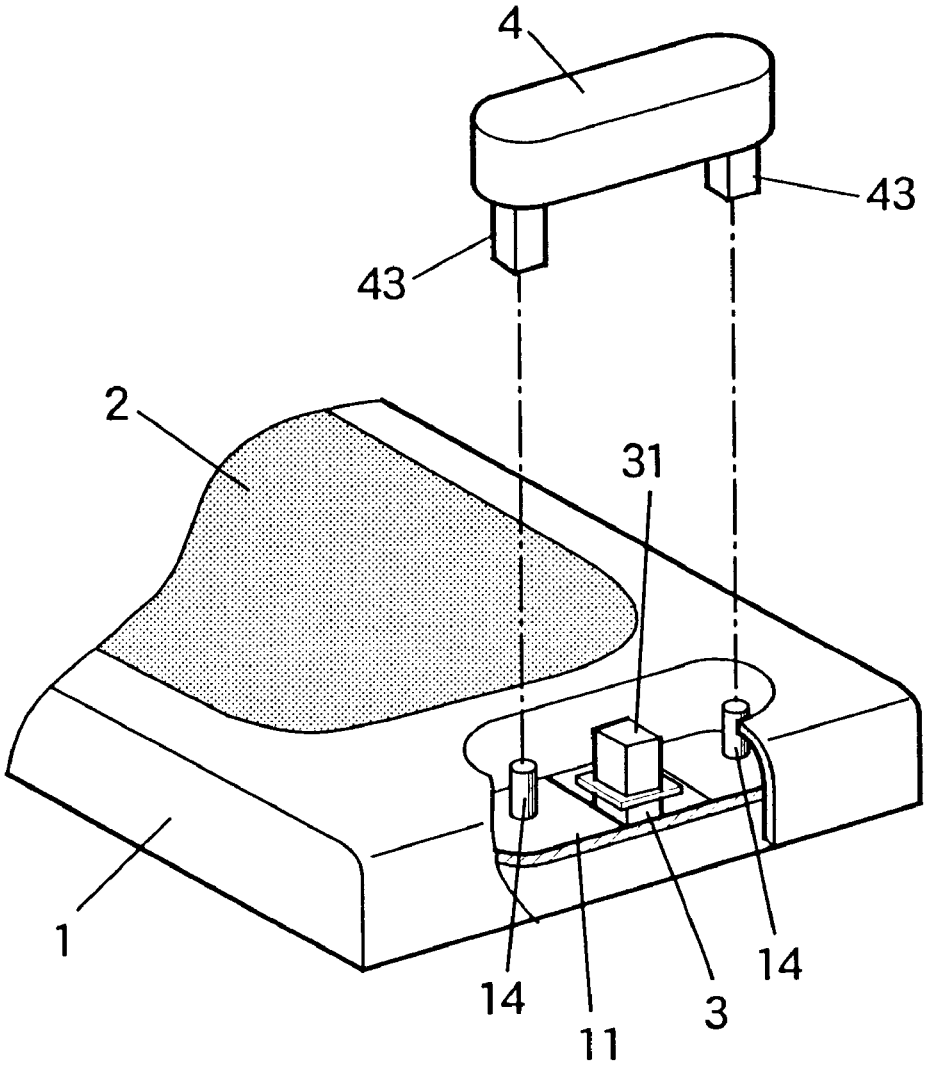
FIG. 5 is an exploded perspective view of the third mode of embodiment.
Figures 1, 6:
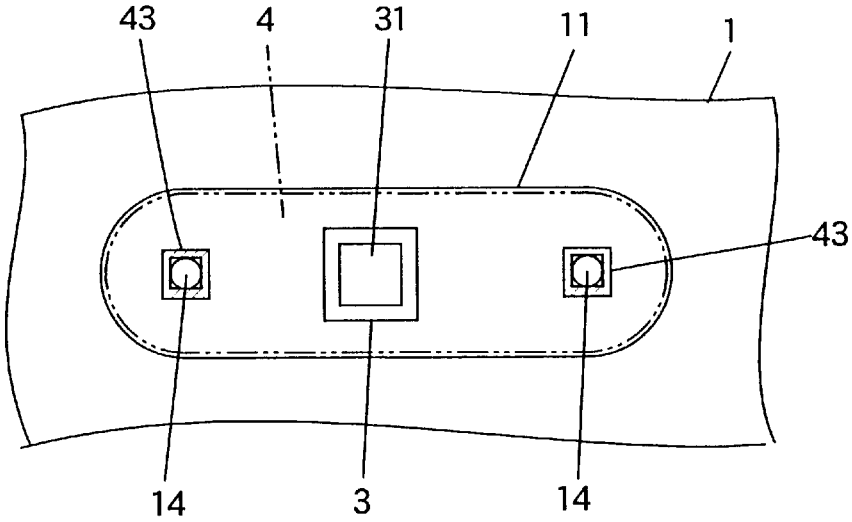
Figures 2, 6:
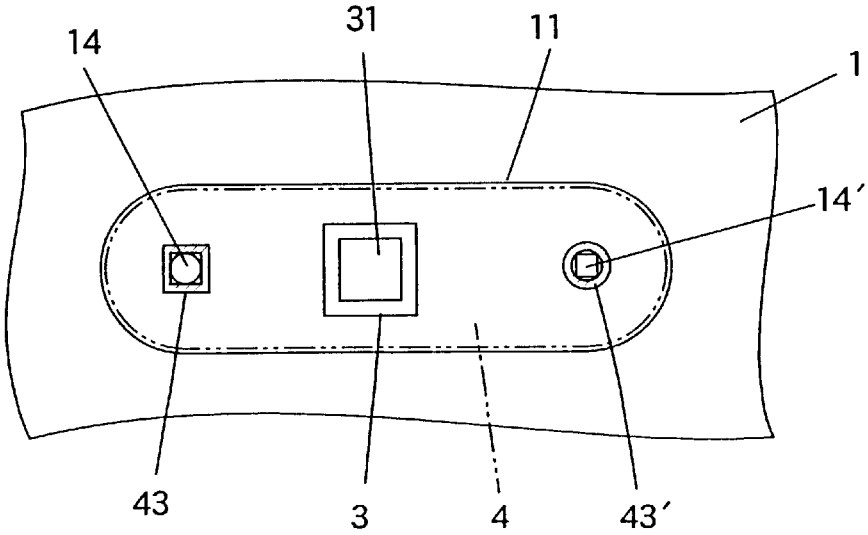
Figure 7:
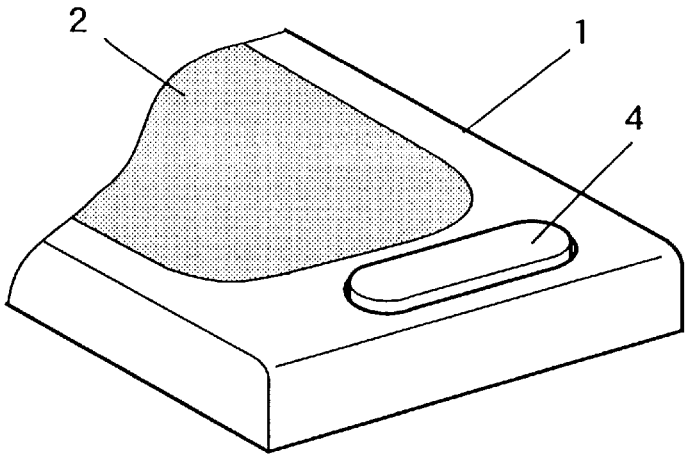
FIG.7 (PRIOR ART)
FIG. 7 is a perspective view showing part of the automotive indoor light.
Figure 8:
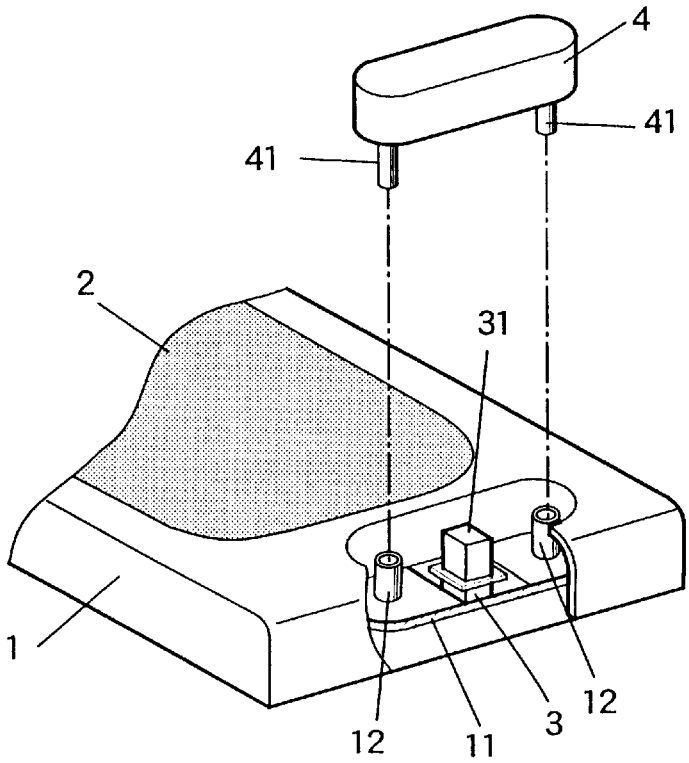
FIG.8 (PRIOR ART)
FIG. 8 is an exploded perspective view showing the prior art.
Figure 9:
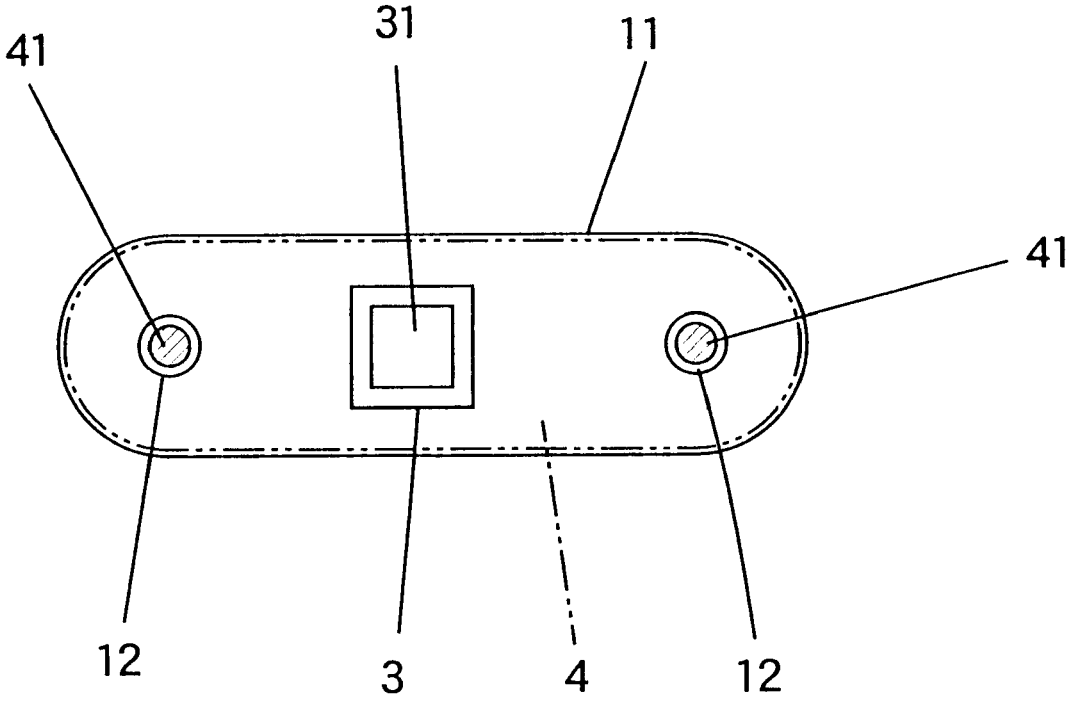
FIG.9 (PRIOR ART)
FIG. 9 is a cross sectional plan view showing the primary portion of the above figure.

The afore-mentioned two modes of embodiment show the use of the rods on the push button 4 and the bearings on the housing 1 but bearings may be provided on the push button 4 and cylindrical rods, on the platform 11 as shown in FIG. 5 and FIG. 6-1. Also in this modification, positive on and off actions of the switch 3 is assured by smooth and play-free pressing down.

In this connection, it is also acceptable to modify the embodiment of FIG. 5 and FIG. 6-1 that such bearings 43 on the button 4 are provided in the form of a cylinder while the rods 14 on the housing 11 are square pillars. Further, the tubes for the bearings or the pillars for the rods are not limited to square ones but it is needless to say that triangular or polygonal ones are also acceptable.

Figure 2:
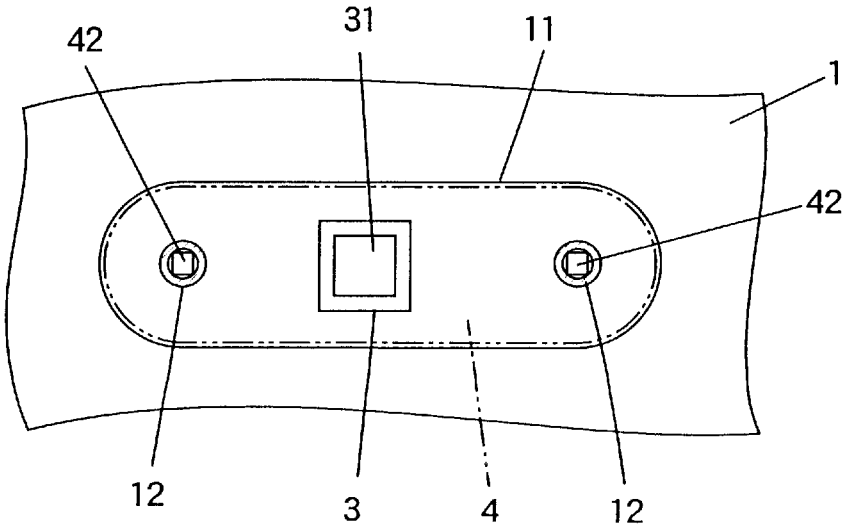
FIG. 2 is a cross sectional plan view showing the primary portion of the above figure.

Further, the rods or bearings provided in pairs in any of the embodiments described in the foregoing are provided all in the same forms on the push button or on the housing but said pair of rods may include a polygonal member and a cylindrical member while said pair of bearings into which said rods are inserted may include a cylindrical member and a polygonal member as shown in FIG. 6-2. In such cases, errors in mounting the button 4 to the platform 11 are forestalled in the event that the orientation of the members are fixed.

Since the present invention is characterized in that one of the rods is provided in a cylindrical form and a corresponding one of the bearings is polygonal, corners of the polygonal members are brought into a linear contact with the mating cylindrical members to assure the reduction in the contact area for minimizing a frictional resistance therebetween. As a result, an unnecessary play between the rods and the bearings are prevented even in a snug fit to ensure that the switch on and off actions are smoothly performed.

Further, the modification by arranging such that one of the rods in the pair is polygonal or cylindrical while the corresponding one of bearings in the pair is cylindrical or polygonal assures the prevention of error in amounting the push button onto the housing in accordance with the orientation fixed in advance.

What is claimed is:

1. A push button support structure for a push switch comprising;

a housing;

a push switch secured to said housing and having an actuator thereon;

a push button reciprocally moveable between on and off positions so as to responsively engage said actuator and thereby perform on and off switching actions, respectively;

a pair of first elongate engagement posts provided on one of said push button and said housing which defines a constant circular cross-sectional geometry, each said elongate engagement post being positioned on a respective side of said push switch so that said push switch is disposed between said pair of first elongate engagement posts; and a pair of second elongate engagement posts, in alignment with said pair of first elongate engagement posts, provided on the other of said push button and said housing which defines a constant square cross-sectional geometry;

respective ones of said first and second pairs of elongate engagement posts being coaxially mated with one another for relative slidable movement therebetween, and being sized and configured so as to establish orthogonally oriented pairs of diametrically opposed linear contact regions therebetween, thereby minimizing frictional resistance during reciprocal movement of said push button.

2. The push button support structure as in claim 1, wherein said first elongate engagement posts are tubular in cross-section, and wherein said second elongate engagement posts are solid in cross-section, and wherein said second elongate engagement posts are received within respective ones of said first elongate engagement posts.

3. The push button support structure as in claim 1, wherein said elongate engagement posts are solid in cross-section, and wherein said second elongate engagement posts are tubular in cross-section, and wherein said first elongate engagement posts are received within respective ones of said second elongate engagement posts.

4. The push button support structure as in claim 1, 2 or 3, wherein said first elongate engagement posts are positioned on said push button, and wherein said second elongate engagement posts are positioned on said housing.

5. The push button support structure as in claim 1, 2 or 3, wherein said first elongate engagement posts are positioned on said housing, and wherein said second elongate engagement posts are positioned on said push button.

* * * * *